US005954303A

United States Patent [19]

Wolf et al.

[11] Patent Number: 5,954,303

[45] Date of Patent: Sep. 21, 1999

[54] ADJUSTABLE WRIST REST SUPPORT AND METHOD

[75] Inventors: Robert J. Wolf, Woodbury; Wayne K. Darvell, North Saint Paul, both of Minn.

[73] Assignee: 3M Innovative Properties Company, St. Paul, Minn.

[21] Appl. No.: 08/924,048

[22] Filed: Aug. 28, 1997

[51] Int. Cl.[6] ..... B43L 15/00

[52] U.S. Cl. ..... 248/118.3; 248/118.1; 248/188.2; 248/918

[58] Field of Search ..... 249/188.1, 188.2, 249/118.1, 118.3, 118.5, 118, 918, 911; 400/715, 718

[56] References Cited

U.S. PATENT DOCUMENTS

| | | | |
|---|---|---|---|
| 793,756 | 7/1905 | Williams | 248/118.5 |
| 3,676,387 | 7/1972 | Lindlof | 260/28.5 B |
| 4,545,554 | 10/1985 | Latino et al. | 248/118.1 |
| 4,678,234 | 7/1987 | Wilson | 297/439 |
| 4,875,259 | 10/1989 | Appledorn | 24/576 |
| 4,973,176 | 11/1990 | Dietrich | 400/715 |
| 5,131,614 | 7/1992 | Garcia et al. | 248/118 |
| 5,184,987 | 2/1993 | Wilkinson | 482/52 |
| 5,219,136 | 6/1993 | Hassel et al. | 248/118 |
| 5,374,018 | 12/1994 | Daneshvar | 248/118 |
| 5,375,800 | 12/1994 | Wilcox et al. | 248/118.1 |
| 5,386,956 | 2/1995 | Hatcher | 248/118 |
| 5,464,292 | 11/1995 | Grant | 400/715 |
| 5,490,647 | 2/1996 | Rice | 248/118.1 |
| 5,507,458 | 4/1996 | Campbell et al. | 248/118.3 |
| 5,547,154 | 8/1996 | Kirchhoff et al. | 248/118.3 |
| 5,591,105 | 1/1997 | Dalebout et al. | 482/52 |

*Primary Examiner*—Ramon O. Ramirez
*Assistant Examiner*—Gwendolyn Baxter
*Attorney, Agent, or Firm*—Michaele A. Hakamaki

[57] ABSTRACT

An adjustable wrist rest assembly that comprises a base portion having an first surface, a second surface opposite the first surface, a first end, a second end opposite the first end, a first longitudinal edge, and a second longitudinal edge opposite the first edge. The wrist rest assembly further includes an elongate pad comprising a support layer and opposite first and second surfaces, wherein the second surface is supported on the first surface of the base portion. The wrist rest assembly further comprises at least one height adjustment member having a first surface and at least one support surface generally opposite the first surface, wherein the first surface of the height adjustment member is mounted on the second surface of the base portion, and wherein the wrist rest pad assembly is supported by the at least one height adjustment member at a first distance above the support surface when located thereon. The wrist rest assembly further includes at least one height adjustment pad having a thickness and a first position being removably attached to the at least one support surface of the at least one height adjustment member, wherein the wrist rest pad assembly is supported by the height adjustment member and pad at a second distance above the support surface when located thereon, and a second position being removed from the at least one support surface of the at least one height adjustment member, wherein the second distance is greater than the first distance.

25 Claims, 4 Drawing Sheets

ADJUSTABLE WRIST REST SUPPORT AND METHOD

TECHNICAL FIELD

The present invention relates to a wrist rest assembly to provide support for the wrists of a user engaged in repetitive motion of the hands and fingers. More specifically, the present invention relates to a height and tilt adjustable wrist rest assembly for use along the front edge of devices to be operated by a person's hands or fingers, such as in the front of a computer keyboard, computer mouse, or other input device.

BACKGROUND OF THE INVENTION

When a person is operating a keyboard or other computer input device, positioning of the wrists in an unsupported manner for long periods of time may lead to repetitive stress injuries such as carpal tunnel syndrome. To lessen these types of injuries, it is common to use wrist rest assemblies along the front edge of a device operated by a person's hands or fingers, such as in front of a computer keyboard, computer mouse, or other input device. It has been suggested that the use of such wrist rest assemblies can limit or eliminate the damage that is sometimes caused by prolonged, repetitive use of these input devices.

One simple type of wrist rest assembly is comprised of an elongated rectangular layer of cushioning material that may be used alone or may be mounted on a base. Wrist rests of this type are typically placed on a work surface directly in front of a keyboard so that the user's wrists can rest on the layer of cushioning material when typing or when resting during a typing session. Although these wrist rest assemblies may provide support for the user's wrists and can help to relieve some stress on the wrists of the user, these assemblies are not height or tilt adjustable to accommodate the needs of different users.

To address the problems related to nonadjustable wrist rest assemblies, several different types of wrist rest assemblies have been provided that allow the user to adjust either the height, the inclination, or both the height and inclination of the wrist rest. One example of a wrist rest assembly having a pad that may be adjusted vertically is described in U.S. Pat. No. 5,547,154 (Kirchhoff et al.), which is commonly owned by the assignee of the present invention. This wrist rest assembly comprises an elongate base assembly on which is supported an elongate pad of cushioning material. The base assembly has a top portion supporting the pad, a bottom portion adapted to be supported on a horizontal surface, and a structure that allows the top portion to be supported on the bottom portion, where the top surface of the pad can be at two different distances above the horizontal surface by switching the ends of the top portion with respect to the ends of the bottom portion. Although this type of device is useful for adjusting a wrist rest to two different vertical heights, it does not allow for any inclination adjustment, which is sometimes also desirable to accommodate each particular user's comfort, needs, and preferences.

Different methods have been proposed for adjusting both the height and inclination of wrist rest assemblies. For one example, U.S. Pat. No. 5,507,458 (Campbell et al.) describes an wrist rest assembly that is adjustable for both height and inclination. This wrist rest comprises a platform having a top surface that is provided with padding, a bottom surface, and two ends. A cup extends from each of the ends, where each cup has grooves on its outer perimeter to rotatably receive a cylinder having grooves on its inner perimeter so that as the cylinder is rotated it moves up or down the cup to change the height of the platform. This assembly also has a means for adjusting the inclination of the wrist rest through the cooperative adjustment of a bolt that extends through a convex shaped cup having a longitudinal slot. Other examples of adjustable wrist rest assemblies include those described in U.S. Pat. No 5,374,018 (Daneshvar), which uses one or more inflatable balloons to set the height and angulation of a wrist support pad, and U.S. Pat. No. 5,375,800 (Wilcox et al.), which uses an eccentric cam for elevation adjustment and a hinged arm for angulation adjustment of a wrist rest. Each of these wrist rest assemblies comprise multiple components that must be precisely manufactured and properly assembled and adjusted before they can be provided to a user.

Thus, the general use of adjustable wrist rest devices is well known. However, there is a continuing need for simple, cost effective adjustable wrist rest assemblies for those using computer input devices such as keyboards.

SUMMARY OF THE INVENTION

One embodiment of the adjustable wrist rest assembly of the present invention is an assembly positionable on a support surface, such as a desk, along the front edge of a device to be operated by a person's hands or fingers for supporting the wrists of a user who is positioned adjacent to the front edge of the support surface. The wrist rest assembly comprises a base portion having an first surface, a second surface opposite the first surface, a first end, a second end opposite the first end, a first longitudinal edge, and a second longitudinal edge opposite the first edge. The wrist rest assembly further includes an elongate pad comprising a support layer and opposite first and second surfaces. The second surface of the pad is supported on the first surface of the base portion, wherein the pad has sufficient support material between the first and second surfaces to afford supporting the wrists of a user on the first surface with a portion of the support layer beneath the wrists of the user. The wrist rest assembly further comprises at least one height adjustment member having a first surface and at least one support surface generally opposite the first surface, wherein the first surface of the height adjustment member is mounted on the second surface of the base portion so that the at least one support surface of the height adjustment member projects away from the base portion, and wherein the wrist rest pad assembly is supported by the at least one height adjustment member at a first distance above the support surface when located thereon. The wrist rest assembly further includes at least one height adjustment pad having a thickness and a first position being removably attached to the at least one support surface of the at least one height adjustment member, wherein the wrist rest pad assembly is supported by the height adjustment member and pad at a second distance above the support surface when located thereon, and a second position being removed from the at least one support surface of the at least one height adjustment member, wherein the second distance is greater than the first distance.

The wrist rest assembly may further include a first height adjustment member positioned closer to the first end of the base portion than to the second end of the base portion and a second height adjustment member positioned closer to the second end of the base portion than to the first end. The support layer of the elongate pad may also comprise a layer of gel.

BRIEF DESCRIPTION OF THE DRAWINGS

The present invention will be further explained with reference to the appended Figures, wherein.

DETAILED DESCRIPTION OF THE PREFERRED EMBODIMENTS

Figure 1:
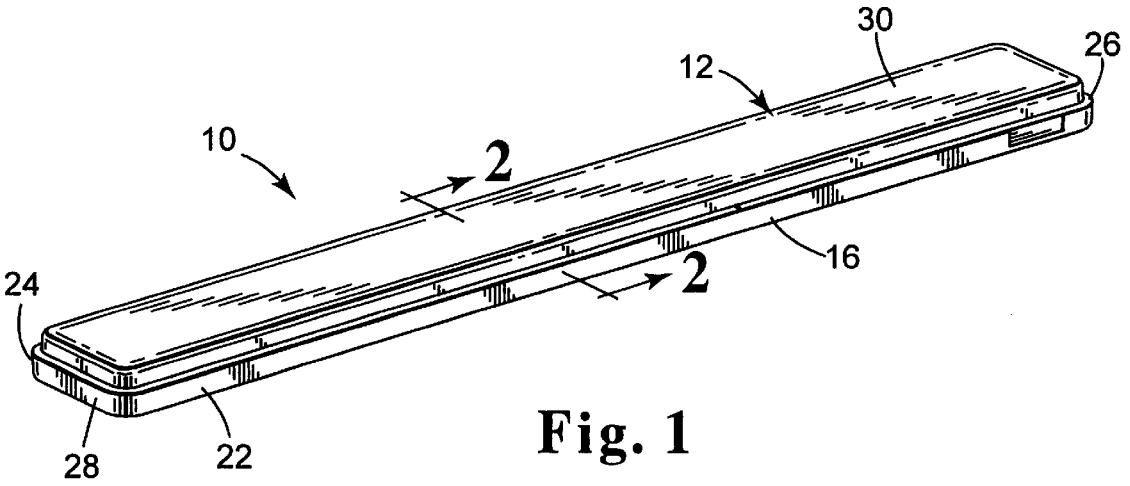
FIG. 1 is an isometric view of one embodiment of a wrist rest assembly according to the present invention.
Figure 2:
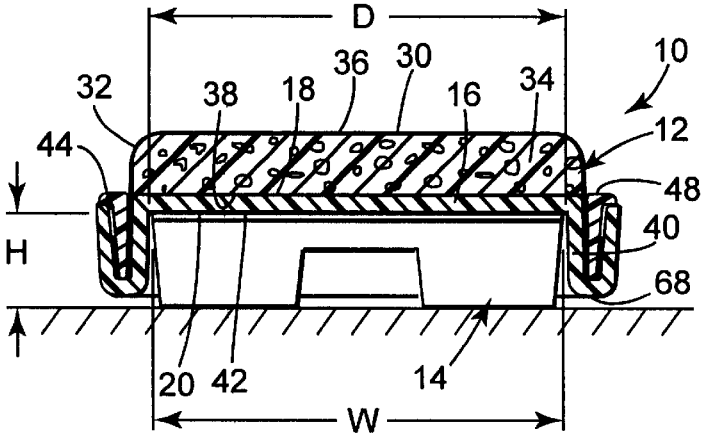
FIG. 2 is a cross-sectional view of a wrist rest assembly taken along line 2—2 of FIG. 1.

Referring now to the Figures, wherein the components are labeled with like numerals throughout the several Figures, and initially to FIGS. 1 and 2, one preferred embodiment of a wrist rest assembly 10 is illustrated which basic components comprise a wrist rest pad assembly 12 and at least one height adjustment member 14. The wrist rest pad assembly 12 is preferably of the type available from the Minnesota Mining and Manufacturing Company of St. Paul, Minn., as 3M™ Gel-Filled Wrist Rests. One specific example is described in U.S. patent application Ser. No. 08/597,323, commonly owned by the assignee of the present invention, the entire disclosure of which is incorporated herein by reference.

The wrist rest pad assembly 12 preferably comprises an elongate base portion 16 having an upper surface 18, a lower surface 20 that is generally parallel to the upper surface 18, longitudinal edge surfaces 22 and 24 on opposite transverse sides of base portion 16, a first end 26, and a second end 28 opposite the first end 26. An elongate pad 30 is positioned on the upper surface 18 of the base portion 16 which comprises a flexible liquid impervious covering layer 32, a layer of gel 34 under the covering layer 32, a top surface 36 and a bottom surface 38. The pad 30 preferably has sufficient support material between its top surface 36 and the upper surface 18 of the base portion 16, and sufficient width between its edges to adequately support a user's wrists along the top surface 36 with a portion of the layer of gel 34 beneath and conforming to the wrists of the user. It is further preferred that the dimensions of the pad 30 are such that the top surface 36 with a wrist supported thereon can move relative to the base portion 16 in a plane generally parallel to the upper surface 18 of the base portion 16. For example, when the gel 34 is similar to the gel described in Example 2 of U.S. Pat. No. 3,676,387, the layer of that gel 34 has a thickness of about ⅜ inch and a width between the edges of the pad 30 of about 2.9 inches. Further, the covering layer 32 of this example comprises a layer of polyurethane, where the motion of the top surface 36 with a wrist supported thereon relative to its bottom surface in a plane generally parallel to the upper surface 18 of the base portion 16 allows the supported wrist and the user's hand to move in any direction in a generally circular area having a diameter of about one inch. The area of such movement could be made larger or smaller by using different gel compositions, but for most embodiments of the wrist rest should be a circular area having a diameter of at least ½ inch.

The wrist rest pad assembly 12 preferably further comprises a lip 40 that projects in a generally perpendicular direction from the base portion 16, although the lip 40 may extend at some other angle from the base portion 16. In the illustrated embodiment, the lip 40 extends around the entire periphery of the base portion 16, however, the lip 40 may instead extend only along portions of the periphery of the base portion. When the lip 40 does extend at least along the longitudinal edge surfaces 22 and 24, a channel 42 is formed on the bottom side of the wrist rest pad assembly 12 by the lip 40 along the longitudinal edge surfaces 22 and 24 and the lower surface 20 extending between these longitudinal edge surfaces. The distance between the lip 40 along the longitudinal edge surfaces 22 and 24 along the lower surface 20 is designated by the letter "D" in FIG. 2.

The layer of gel 34 may be attached to upper surface 18 of the base portion 16 in many different ways, where FIG. 2 illustrates one preferred attachment means. In this embodiment, the base portion 16 has a generally V-shaped groove 44 in the lip 40 adjacent and extending entirely around the upper surface 18. The layer of gel 34 is sandwiched between the upper surface 18 of the elongate base portion 16 and the covering layer 32, which is preferably a laminate material comprising an inner layer of flexible liquid impervious polymeric material ranging between 0.001 inch and 0.002 inch thick and an outer layer of soft conformable material adapted for comfortable contact with a user's wrists (e.g., a nonwoven polyurethane material). Portions of the covering layer 32 project around the periphery of the layer of gel 34 and are positioned in the groove 44. The wrist rest pad assembly 12 further preferably includes a sealing member 48 in the groove 44 on the side of the covering layer 32 opposite the base portion 16, where the sealing member 48 is attached to the base portion 16 to retain the portions of the covering layer 32 in the groove 44. One preferred method of making the pad 12 of the present invention is described in U.S. patent application Ser. No. 08/571,255, commonly owned by the assignee of the present invention, the entire disclosure of which is incorporated herein by reference.

Although it is preferred that a layer of gel be used in the wrist rest pad assembly 12, the elongate pad 30 could instead comprise a different support material, such as an open-cell foam, a closed-cell foam, liquid or particulate filled bags or pouches, wood, plastic, metal, or any other material suitable for supporting the wrists of a user. The support material may also be a combination of these or other suitable materials, depending on the preferences of the manufacturer and the user. If a support material other than gel is used in the wrist rest pad assembly 12, it is understood that a covering layer 32 may or may not be used and that the configuration of the base may change.

Figure 3:
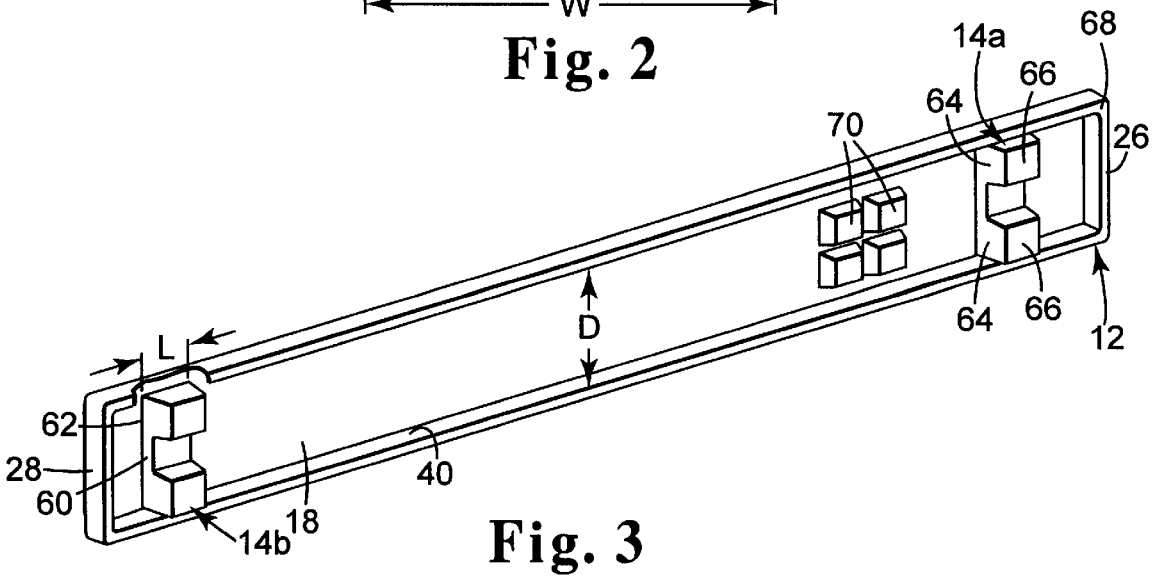
FIG. 3 is an isometric view of the bottom side of the wrist rest assembly of FIG. 1.

As best illustrated in FIGS. 2 and 3, each height adjustment member 14 preferably comprises a body 60 having a top surface 62, and two legs 64, wherein each leg 64 has a lower, skid-resistant surface 66. Each member 14 has a width W which is equal to the width of the body 60 and a height H which is equal to the total height of the height adjustment member 14 between the top surface 62 and the lower surface 66 of the legs 64. In this embodiment, the width W is preferably slightly smaller than the distance D between the portion of the lip 40 along the longitudinal edge surface 22 and the portion of the lip 40 along the longitudinal edge surface 24, so that the height adjustment member 14 can fit into the channel 42 and be secured to the lower surface 20 of the base portion 16.

It is preferred that the lower skid-resistant surface 66 of each leg 64 is generally square in shape. However, it is also contemplated that the lower surface 66 of each leg 64 have a different shape, such as rectangular, circular, triangular, or the like.

In the preferred embodiment, the wrist rest assembly 10 includes more than one height adjustment member 14, where each member 14 is spaced from each adjacent member 14 along the length of the elongate base portion 16. It is most preferred that the wrist rest assembly 10 comprise two height adjustment members 14*a* and 14*b* spaced from each other along the length of the base portion 16, as illustrated in FIG. 3. In this embodiment, the first height adjustment member 14*a* is positioned near the first end 26 of the base portion 16 and the second height adjustment member 14*b* is positioned near the second end 28 of the base portion 16. The distance between height adjustment members 14*a* and 14*b* is preferably selected to provide adequate stability for the wrist rest assembly 10 when placed on a surface so that the wrist rest assembly 10 does not tip or rock when a user's wrists are placed on its surface.

Figure 4:
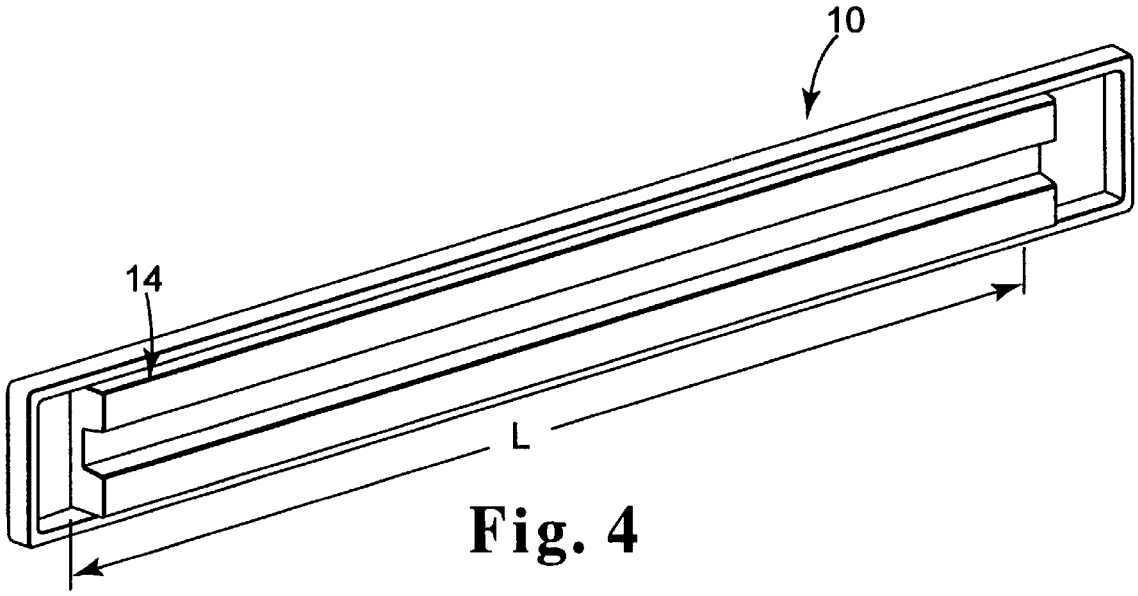
FIG. 4 is an isometric view of the bottom side of another embodiment of the wrist rest assembly of the present invention.

It is also contemplated that the wrist rest assembly 10 comprise more than two height adjustment members 14. For example, a third height adjustment member (not shown) could be positioned between the first and second members 14*a* and 14*b* along the length of the base portion 16. It is further understood that only a single height adjustment member 14 may be mounted to the base portion 16. In the alternative embodiment illustrated in FIG. 4, only a single height adjustment member 14 is used, where the member 14 extends further in the longitudinal direction of the base portion 16 than in the embodiment of FIG. 3 (i.e., the length L of the member 14 of FIG. 4 is larger than the length L of the member 14 of FIG. 3). In this embodiment, the single member 14 should be sufficiently large to support the base portion 16 securely on a surface, such as a desk, while preventing excessive slippage across a surface and/or tipping of the base 16.

The height H of the height adjustment member 14 is preferably selected so that the two legs 64 of each member 14 extend below a bottom surface 68 of the wrist rest pad assembly 12. In this configuration, when the wrist rest assembly 10 is placed on a surface, such as a desk, the lower surface 66 of the legs 64 will contact the desk surface in order to support the base portion 16 and to prevent or limit undesirable movement of the wrist rest assembly 10 when the assembly is in use. It is noted that the skid-resistant properties of the lower surface 66 of the legs 64 may be accomplished in many ways, including selecting a leg material that itself provides adequate friction between the lower surface 66 of the leg 64 and the surface with which it will come in contact. Alternatively, a layer of skid-resistant material may be attached to the lower surface 66, or the lower surface 66 may be textured in some way to provide the desired level of skid-resistance between the two surfaces. In any case, the material that will come in contact with the surface on which the wrist rest assembly 10 is placed should be selected so that the surface of the wrist rest assembly 10 that comes in contact with a surface does not slide easily along that surface when in use. In addition, the material selected should not damage the surface on which the assembly is placed, such as a desk surface, when the wrist rest assembly 10 is being used or moved by the user.

Each height adjustment member 14 is preferably constructed from a polyurethane material such as that used for the 3M™ SJ-5023 Bumpon™ pad, commercially available from the Minnesota Mining and Manufacturing Company of St. Paul, Minn. It is understood, however, that the member 14 may be constructed from other suitable materials such as plastic, wood, rubber, or the like. Although many materials may be appropriate for the member 14, it is preferred that the material selected is skid-resistant and also resistant to abrasion, marring, and staining.

Each height adjustment member 14 is preferably attached to the lower surface 20 of the base portion 16 with an adhesive or adhesive tape placed between the top surface 62 of the body 60 and the lower surface 20 of the base portion. It is preferred that the adhesive be a high tack rubber-based adhesive (e.g., natural rubber adhesive) that provides shock resistance and adhesion to a variety of surfaces, or a high strength acrylic-based adhesive (e.g., acrylic adhesive ) that adheres well to high surface energy plastics, where the adhesive is selected to provide the desired level of adhesion between the height adjustment member 14 and the lower surface 20 of the base portion 16.

Each height adjustment member 14 may instead be attached to the lower surface 20 of the base portion 16 by other known attachment means, such as with a double-sided adhesive tape, hot-melt adhesive, intermeshing structured surfaces (such as that disclosed in U.S. Pat. No. 4,875,259, which is commonly owned by the assignee of the present invention), hook and loop fasteners of the type comprising a loop fabric on one surface that engages with hooks on a mating surface to attach the two surfaces together, and the like. Alternatively, each height adjustment member 14 may be molded into the base portion 16, where the member 14 is preferably constructed of the same material as the base portion 16, although it may be constructed of a different material. However, the lower surface 66 of each of these legs 64 should still be skid-resistant.

Although the height adjustment member 14 is shown as a single piece construction in this embodiment, the member 14 may instead be formed from several pieces attached to each other by adhesives, welding, or other attachment methods (e.g., the body 60 and legs 64 may be individual pieces secured to each other). If the member 14 is made up of several pieces, the pieces may be the same or different materials, as desired.

Figure 5:
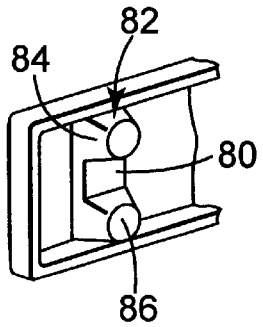
FIG. 5 is a partial isometric view of the bottom side of a wrist rest assembly similar to that shown in FIG. 3 and showing another embodiment of a height adjustment member.

One preferred shape of the height adjustment member 14 is shown in FIG. 3, where the top surface 62 of the body 60 is generally rectangular and tapers to the lower surfaces 66 of each of the legs 64, which are preferably square or rectangular and are preferably spaced from each other. However, the height adjustment member 14 may have any number of different shapes than that shown in FIG. 3, as long as the lower surface 66 of the member 14 that comes in contact with a surface, such as a desk, provides the desired skid-resistance and stability for the wrist rest assembly 10. Other shapes for the height adjustment member 14 may include, for example, a body 60 that is circular, triangular, elliptical, or the like in shape when viewed from the top surface 62 of the body 60 (not shown). Similarly, the lower surface 66 of each of the legs 64 may also have other shapes than square or rectangular, such as circular, triangular, elliptical, or the like. Further, the selected shape for the body 60 may be chosen independently of the shape of the legs 64, where one example is illustrated in FIG. 5. In this embodiment, a body 80 of a height adjustment member 82 is rectangular and the portion of each leg 84 closest to the body 80 are generally square but taper to a circular bottom surface 86. While FIG. 5 shows one choice of shapes for the parts of a height adjustment member, it is understood that any combination of shapes for the parts of each height adjustment member may be chosen, where it is possible that the shapes of each of the legs of one height adjustment member are different from each other.

Figure 6:
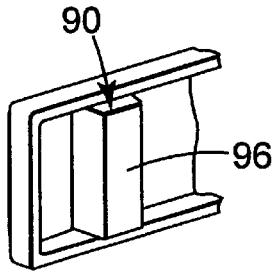
FIG. 6 is a partial isometric view similar to that shown in FIG. 5 and showing another embodiment of a height adjustment member.

Another alternative design of the height adjustment member is shown in FIG. 6. In this embodiment, a height adjustment member 90 does not have multiple legs on its bottom surface, but instead comprises a single piece or block of material having a single lower surface 96. This lower surface 96 preferably has similar characteristics to the lower skid-resistant surface 66 of the legs 64 described above with respect to FIGS. 2 and 3 and can be any desirable shape, such as rectangular, circular, or the like.

Figure 7:
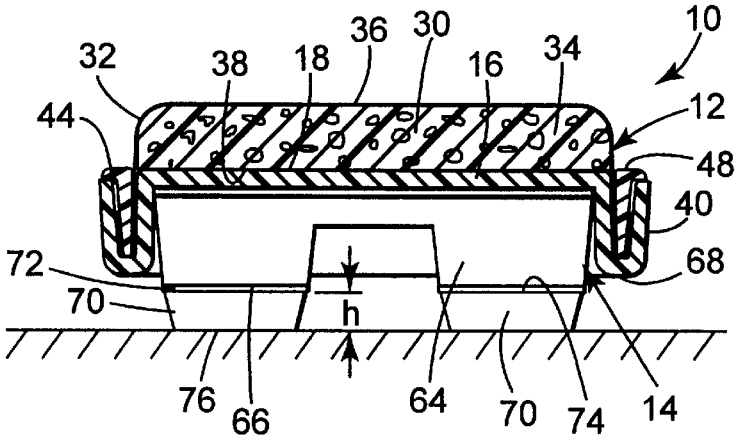
FIG. 7 is a cross-sectional view of a wrist rest assembly taken along line 2—2 of FIG. 1, with the addition of height adjustment pads on both legs of the height adjustment member.

As discussed above with regard to the use of wrist rest assemblies, different users of input devices (such as keyboards) often have different needs and preferences with regard to the positioning of their equipment. For example, some users prefer having the top of a wrist rest device at a greater distance from a desk surface than other users. FIG. 7 illustrates one preferred configuration of the wrist rest assembly 10 of the present invention, where the wrist rest pad assembly 12 of FIGS. 1 through 3 is raised further from the desk surface. In this embodiment, an adjustment pad 70 having a height h is mounted to the lower surface 66 of each leg 64 of the height adjustment member 14. As illustrated, the addition of these adjustment pads 70 raises the top surface 36 of the elongate pad 30 by the height h so that it is positioned at a greater distance from the surface on which the wrist rest assembly 10 is placed than shown in FIG. 2. In this way, a user's wrists can be supported at a higher position relative to the desk surface than when adjustment pads 70 are not used.

It is further preferred that each adjustment pad 70 has a bottom surface 76 and top surface 74 with a pressure sensitive adhesive layer 72 mounted thereon which can be used to adhere the pad 70 to the lower surface 66 of a leg 64. The pressure sensitive adhesive layer 72 may be, for example, a natural rubber. The adhesive should be selected so that each adjustment pad 70 will adhere securely to the bottom surface 66 of a leg 64 when desired, but also so that each adjustment pad 70 can be removed from the bottom surface 66 of a leg 64 with minimal effort when desired by the user. It is also preferred that the adhesive selected is reusable so that each adjustment pad 70 may be repeatedly mounted to and removed from the bottom surface 66 of a leg 64 to accommodate the changing preferences of the user of the wrist rest assembly. Further, the adhesive layer 72 may cover the entire top surface 74 of each adjustment pad 70 or may cover only a portion of the top surface 74 of the adjustment pad 70 in order to achieve secure adhesion between each pad 70 and bottom surface 66, while allowing the desired level of release between each pad 70 and bottom leg surface 66.

The adjustment pads 70 may be constructed from a material such as the polyurethane used for the 3M™ SJ-5018 Bumpon™ pad, commercially available from the Minnesota Mining and Manufacturing Company of St. Paul, Minn. It is understood, however, that the adjustment pads 70 may be constructed from other suitable materials such as plastic, wood, rubber, or the like. It is further preferred that the top surface 74 of each adjustment pad 70 has the same or similar shape as the lower surface 66 of the legs 64 so that the adjustment pad 70 has a similar corresponding surface to which it can adhere. In one preferred embodiment, 3M™ SJ-5018 Bumpon™ pads having generally square top and bottom surfaces 74 and 76 are used as the adjustment pads 70. In this embodiment, the lower surface 66 of each leg 64 has the same or similar shape and size as that of the top surface 74 of the pad 70. However, the size and shape of the lower leg surface 66 need not necessarily correspond to the size and shape of the top surface 74 of the pad 70.

It is preferable that the bottom surface 76 of the pad 70 has similar skid-resistant properties to the lower surface 66 of the legs 64 described above. As with the lower surface 66 of the legs 64, skid-resistance may be accomplished in many ways, including selecting a material that itself provides adequate friction between the bottom surface 76 of the pad 70 and the surface with which it will come in contact. Alternatively, a layer of skid-resistant material may be attached to the bottom surface 76, or the bottom surface 76 may be textured in some way to provide the desired level of skid-resistance between the two surfaces.

When adjustment pads 70 are used to change the height of the wrist rest assembly 10, as shown in the illustrated example of FIG. 7, it is preferable that the same number of pads 70 (each having the same height h) be placed on each leg 64 of each height adjustment member 14 along the length of the base portion 16 so that the wrist rest assembly 10 is raised uniformly across its length. For example, if the user desires to uniformly raise the height of the wrist rest assembly by the height h of one adjustment pad 70, the user should place one adjustment pad 70 on every leg 64 of every height adjustment member 14. In a like manner, if the user desires to raise the height of the wrist rest assembly 10 by the height of two adjustment pads 70, the user should stack two pads 70 on every leg 64 of every height adjustment member 14 on that wrist rest assembly 10. The wrist rest assembly 10 may also be provided with adjustment pads 70 having various heights h so that the user can use the adjustment pads 70 having a height h that most closely corresponds to the distance the user desires to raise the wrist rest assembly from the surface on which it is placed, where pads having the same height h are preferably used on each leg 64.

Figure 8:
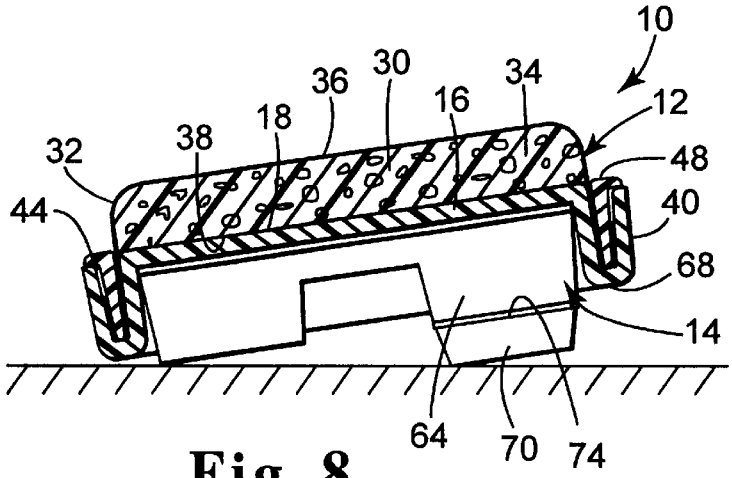
FIG. 8 is a cross-sectional view of a wrist rest assembly taken along line 2—2 of FIG. 1, with the addition of a height adjustment pad on one leg of the height adjustment member.

FIG. 8 illustrates another configuration of the wrist rest assembly 10 of the present invention, where the wrist rest pad assembly 12 of FIGS. 1 through 3 is inclined with respect to the desk surface. In this embodiment, an adjustment pad 70 having a height h is mounted to the lower surface 66 of only one leg 64 of each of the height adjustment member 14 along one of the longitudinal edge surfaces 22 or 24. As illustrated, the addition of these adjustment pads 70 raises the one side of the top surface 36 of the elongate pad 30 with respect to the other side of the top surface 36 so that it is positioned at an angle with respect to the surface on which the wrist rest assembly 10 is placed to support a user's wrists at a different angle than when adjustment pads 70 are not used.

It is also preferred that the height adjustment pads 70 be placed in the same relative position on each height adjustment member 14 so that the wrist rest assembly 10 is at a uniform inclination across its length. In other words, if one adjustment pad 70 is placed on the leg 64 closer to the longitudinal edge surface 22 on one height adjustment member 14, an adjustment pad 70 should also be placed on the leg 64 closer to the longitudinal edge surface 22 on every other height adjustment member 14 along the length of the base portion 16.

It is also within the scope of the present invention that a user may adjust both height and inclination of the wrist rest assembly 10 by placing different numbers of pads 70 on the legs of the height adjustment members or pads 70 having different heights h on the legs of the height adjustment members along the length of the base portion 16. In any of these configurations, however, it is preferred that the same number of height adjustment pads 70 having the same heights h be used in the same relative location (i.e., along the same longitudinal edge 22 or 24) on each of the height adjustment members 14 to maintain both uniform height and inclination of the wrist rest assembly 10 across its length.

Figure 9:
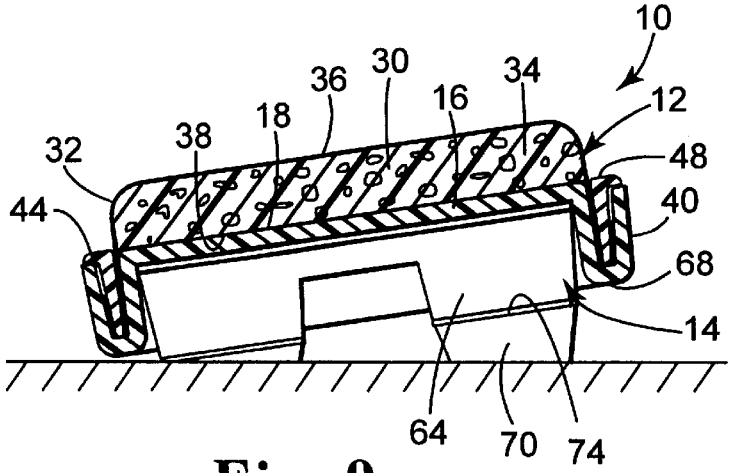
FIG. 9 is a cross-sectional view of a wrist rest assembly similar to that shown in FIG. 8, using an alternate configuration of the height adjustment pads.

Each height adjustment pad 70 may have a top surface 74 that is generally parallel to its bottom surface 76, as shown in FIGS. 7 and 8, for example. However, the top surface 74 of each pad 70 may instead be at an angle relative to the bottom surface 76 so that the pad 70 is in a wedge-like shape, such as the pad shown in FIG. 9. Pads of this general shape may be used when it is desirable to increase the amount of pad surface area that comes in contact with the surface on which the wrist rest assembly 10 is positioned. Wedge-shaped or other alternatively shaped pads may also be useful when a specific inclination of the wrist rest assembly is desired. In this case, specific pads could be manufactured to be placed on the height adjustment members to achieve a certain inclination of a wrist rest assembly. Further, wedge-shaped or alternatively shaped pads may be used in combination with each other or in combination with pads of the type shown in FIGS. 7 and 8 to vary the height and inclination of the wrist rest assembly 10.

In order to accomplish the height and inclination adjustments described above, each wrist rest assembly 10 should be provided with multiple height adjustment pads 70. More specifically, it is preferred that at least one height adjustment pad 70 be provided for each leg 64 of each height adjustment member 14 of a wrist rest assembly 10 so that the user can adjust the wrist rest assembly 10 to accommodate his or her preferences. It is further preferred that the height adjustment pads 70 be releasably adhered to the lower surface 20 of the base portion 16 so that the pads 70 are conveniently available for the user when the user decides to use the pads to adjust the height and/or the inclination of the wrist rest assembly 10. In this way, the user who desires to add the pads 70 to the height adjustment members 14 does not need to search for the adjustment pads and has a convenient place to store pads that have been removed from the height adjustment members for reuse at a later time. Depending on the adhesive chosen for the adhesive layer 72 of the adjustment pads 70, the pads may be releasably adhered directly to the lower surface 20 of the base portion 16. Alternatively, a release liner material (not shown) may be attached to the lower surface 20 of the base portion so that the adjustment pads 70 may be releasably adhered thereto.

Figure 10:
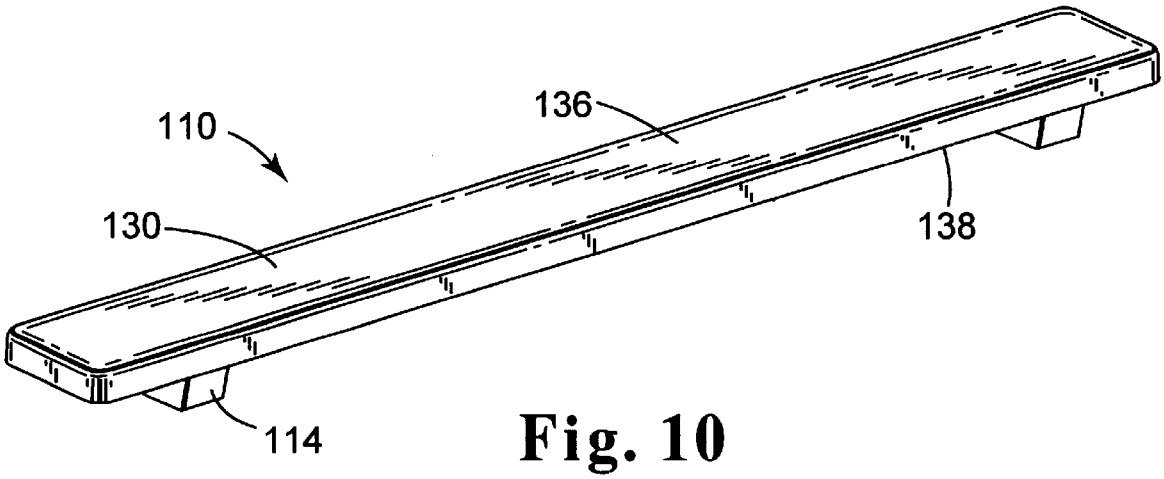
FIG. 10 is a partial isometric view of another embodiment of a wrist rest assembly of the present invention.

Another embodiment of the present invention is illustrated in FIG. 10. In this embodiment, a wrist rest assembly 110 comprises an elongate pad 130 which comprises a top surface 136, a bottom surface 138, and a layer of a suitable support material, such as a gel or other suitable material such as those described above with respect to the wrist rest pad assembly of FIG. 1 (not shown), provided between the top and bottom surfaces. The pad 130 preferably has a sufficient thickness between its top surface 136 and bottom surface 138 and sufficient width between its edges to adequately support a user's wrists along the top surface 136 with a portion of the support material beneath the wrists of the user. It is also preferred that the top and bottom surfaces 136, 138 and support material are chosen so that the wrist rest assembly 110 is sufficiently conformable to accommodate the wrists of a user while being sufficiently rigid so as to not excessively bend or deform under load. In this embodiment, the height and inclination of the wrist rest assembly 110 can be adjusted by any of the methods and devices described above with respect to the embodiments of FIGS. 1 through 9. For one example, FIG. 10 shows two height adjustment members 114 attached to the bottom surface 138 of the pad 130, where adjustment pads (not shown) may be added to the bottom of the members 114 to change the height and inclination of the wrist rest assembly 110.

The present invention has now been described with reference to several embodiments thereof The foregoing detailed description and examples have been given for clarity of understanding only. No unnecessary limitations are to be understood therefrom. It will be apparent to those skilled in the art that many changes can be made in the embodiments described without departing from the scope of the invention. For example, height adjustment pads could be attached to a surface that supports such devices as keyboard drawers and mousing surfaces to provide a simple way to change the height and/or tilt of the devices to accommodate the preferences of a user. Thus, the scope of the present invention should not be limited to the structures described herein, but only by the structures described by the language of the claims and the equivalents of those structures.

We claim:

1. An adjustable wrist rest assembly positionable on a support surface along the front edge of a device to be operated by a user's hands or fingers for supporting the wrists of the user who is positioned adjacent to the front edge of the support surface, the wrist rest assembly comprising:

a wrist rest pad assembly comprising a base portion having an first surface, a second surface opposite the first surface, a first end, a second end opposite the first end, a first longitudinal edge, and a second longitudinal edge opposite the first edge, and an elongate pad comprising a support layer and opposite first and second surfaces, wherein the second surface of the pad is supported on the first surface of the base portion, and wherein the pad has sufficient support material between the first and second surfaces to afford supporting the wrists of the user on the first surface with a portion of the support layer beneath the wrists of the user;

at least one height adjustment member having a first surface and at least one skid-resistant support surface generally opposite the first surface, wherein the first surface of the height adjustment member is mounted on the second surface of the base portion so that the at least one support surface of the height adjustment member projects away from the base portion, and wherein the wrist rest pad assembly is supported by the at least one height adjustment member at a first distance above the support surface when located thereon; and at least one skid-resistant height adjustment pad having a thickness and a first position being removably attached to the at least one support surface of the at least one height adjustment member, wherein the wrist rest pad assembly is supported by the height adjustment member and pad at a second distance above the support surface when located thereon, and a second position being removed from the at least one support surface of the at least one height adjustment member, wherein the second distance is greater than the first distance.

2. The adjustable wrist rest assembly of claim 1, further comprising first and second height adjustment members, wherein the first height adjustment member is positioned closer to the first end of the base portion than to the second end and the second height adjustment member is positioned closer to the second end of the base portion than to the first end.

3. The adjustable wrist rest assembly of claim 1, wherein each of the at least one height adjustment members further comprises at least one leg portion.

4. The adjustable wrist rest assembly of claim 3, wherein each of the at least one leg portions comprises the at least one support surface of the height adjustment member.

5. The adjustable wrist rest assembly of claim 1, wherein the at least one height adjustment pad is removably attached to each of the at least one height adjustment members closer to the first longitudinal edge of the wrist rest pad assembly than to the second longitudinal edge to incline the wrist rest assembly relative to the support surface.

6. The adjustable wrist rest assembly of claim 1, wherein each of the at least one height adjustment members further comprises a first leg portion and a second leg portion spaced from the first leg portion, wherein the first leg portion of each of the at least one height adjustment members is closer to the first longitudinal edge of the wrist rest pad assembly than to the second longitudinal edge.

7. The adjustable wrist rest assembly of claim 6, wherein the first leg portion comprises a first support surface and the second leg portion comprises a second support surface.

8. The adjustable wrist rest assembly of claim 6, wherein the at least one height adjustment pad is removably attached to the first leg portion of each of the at least one height adjustment members to incline the wrist rest assembly relative to the support surface.

9. The adjustable wrist rest assembly of claim 1, wherein the support layer comprises a layer of gel for conforming to the supported wrists of the user and to afford significant motion of the first surface of the pad with the supported wrists relative to the second surface of the pad in a horizontal plane.

10. The adjustable wrist rest assembly of claim 1, wherein the at least one height adjustment pad is comprised of a polyurethane material.

11. The adjustable wrist rest assembly of claim 1, wherein the at least one height adjustment member is comprised of a polyurethane material.

12. The adjustable wrist rest assembly of claim 1, wherein each of the at least one height adjustment pads has a top surface that is generally parallel to an opposite bottom surface.

13. An adjustable wrist rest assembly positionable on a support surface along the front edge of a device to be operated by a user's hands or fingers for supporting the wrists of the user who is positioned adjacent to the front edge of the support surface, the wrist rest assembly comprising:

an elongate pad comprising a support layer and opposite first and second surfaces, wherein the pad has sufficient support material between the first and second surfaces to afford supporting the wrists of the user on the first surface with a portion of the support layer beneath the wrists of the user;

at least one height adjustment member having a first surface and at least one skid-resistant support surface generally opposite the first surface, wherein the first surface of the height adjustment member is mounted on the second surface of the pad so that the at least one support surface of the height adjustment member projects away from the second surface of the pad, and wherein the elongate pad is supported by the at least one height adjustment member at a first distance above the support surface when located thereon; and at least one skid-resistant height adjustment pad having a thickness and a first position being removably attached to the at least one support surface of the at least one height adjustment member, wherein the elongate pad is supported by the height adjustment member and pad at a second distance above the support surface when supported thereon, and a second position being removed from the at least one support surface of the at least one height adjustment member, wherein the second distance is greater than the first distance.

14. The adjustable wrist rest assembly of claim 13, wherein the elongate pad comprises a first end and a second end opposite the first end, and further comprising first and second height adjustment members, wherein the first height adjustment member is positioned closer to the first end of the elongate pad than to the second end and the second height adjustment member is positioned closer to the second end of the elongate pad than to the first end.

15. The adjustable wrist rest assembly of claim 13, wherein each of the at least one height adjustment members further comprises at least one leg portion.

16. The adjustable wrist assembly of claim 15, wherein each of the at least one leg portions comprises the at least one support surface of the height adjustment member.

17. The adjustable wrist assembly of claim 13, wherein the elongate pad further comprises first and second opposite longitudinal edges wherein each of the at least one height adjustment members further comprises a first leg portion and a second leg portion spaced from the first leg portion, and wherein the first leg portion of each of the at least one height adjustment members is closer to the first longitudinal edge of the elongate pad than to the second longitudinal edge.

18. The adjustable wrist rest assembly of claim 17, wherein the at least one height adjustment pad is removably attached to the first leg portion of each of the at least one height adjustment members to incline the wrist rest assembly relative to the support surface.

19. An adjustable wrist rest assembly positionable on a support surface along the front edge of a device to be operated by a user's hands or fingers for supporting the wrists of the user who is positioned adjacent to the front edge of the support surface, the wrist rest assembly comprising:

a wrist rest pad assembly comprising a base portion having an first surface, a second surface opposite the first surface, a first end, a second end opposite the first end, a first longitudinal edge, and a second longitudinal edge opposite the first edge, and an elongate pad comprising a support layer, the pad having opposite first and second surfaces, wherein the second surface of the pad is supported on the first surface of the base portion, and wherein the pad has sufficient support material between the first and second surfaces to afford supporting the wrists of the user on the first surface with a portion of the support layer beneath the wrists of the user;

at least two height adjustment members having a first surface and two support surfaces generally opposite the first surface, wherein the first surface of each height adjustment member is mounted on the second surface of the base portion so that the two support surfaces of the height adjustment member project away from the base portion, and wherein the wrist rest pad assembly is supported by the at least two height adjustment members at a first distance above the support surface when located thereon; and at least one height adjustment pad having a thickness and a first position being removably attached to the at least one of the two support surfaces of the at least two height adjustment members, wherein the wrist rest pad assembly is supported by the height adjustment member and pad at a second distance above the support surface when located thereon, and a second position being removed from at least one of the two support surfaces of the at least two height adjustment members, wherein the second distance is greater than the first distance.

20. An adjustable wrist assembly positionable on a support surface along the front edge of a device to be operated by a user's hands or fingers for supporting the wrists of the user who is positioned adjacent to the front edge of the support surface, the wrist rest assembly comprising:

a wrist rest pad assembly comprising a base portion having an first surface, a second surface opposite the first surface, a first end, a second end opposite the first end, a first longitudinal edge, a second longitudinal edge opposite the first edge, and at least one skid-resistant height adjustment member comprising at least one support surface projecting away from the base portion, and wherein the wrist rest pad assembly is supported by the at least one height adjustment member at a first distance above the support surface when located thereon, and an elongate pad comprising a support layer and opposite first and second surfaces, wherein the second surface of the pad is supported on the first surface of the base portion, and wherein the pad has sufficient support material between the first and second surfaces to afford supporting the wrists of the user on the first surface with a portion of the support layer beneath the wrists of the user; and at least one skid-resistant height adjustment pad having a thickness and a first position being removably attached to the at least one support surface of the at least one height adjustment member, wherein the wrist rest pad assembly is supported by the height adjustment member and pad at a second distance above the support surface when located thereon, and a second position being removed from the at least one support surface of the at least one height adjustment member, wherein the second distance is greater than the first distance.

21. An adjustable wrist rest assembly positionable on a support surface along the front edge of a device to be operated by a user's hands or fingers for supporting the wrists of the user who is positioned adjacent to the front edge of the support surface, the wrist rest assembly comprising:

a wrist rest pad assembly comprising a base portion having an first surface, a second surface opposite the first surface, a first end, a second end opposite the first end, a first longitudinal edge, and a second longitudinal edge opposite the first edge, and an elongate pad comprising a support layer and opposite first and second surfaces, wherein the second surface of the pad is supported on the first surface of the base portion, and wherein the pad has sufficient support material between the first and second surfaces to afford supporting the wrists of the user on the first surface with a portion of the support layer beneath the wrists of the user;

at least one skid-resistant height adjustment member having a first surface and at least one support surface generally opposite the first surface, wherein the first surface of the height adjustment member is mounted on the second surface of the base portion so that the at least one support surface of the height adjustment member projects away from the base portion, and wherein the wrist rest pad assembly is supported by the at least one height adjustment member at a first distance above the support surface when located thereon; and at least one skid-resistant height adjustment pad having a thickness and a first position being removably attached to the at least one support surface of the at least one height adjustment member, wherein the wrist rest pad assembly is supported by the height adjustment member and pad at a second distance above the support surface when located thereon, and a second position being removed from the at least one support surface of the at least one height adjustment member, wherein the second distance is greater than the first distance, and wherein the at least one height adjustment pad is removably attached to each of the at least one height adjustment members closer to the first longitudinal edge of the wrist rest pad assembly than to the second longitudinal edge to incline the wrist rest assembly relative to the support surface.

22. An adjustable wrist rest assembly positionable on a support surface along the front edge of a device to be operated by a user's hands or fingers for supporting the wrists of the user who is positioned adjacent to the front edge of the support surface, the wrist rest assembly comprising:

a wrist rest pad assembly comprising a base portion having an first surface, a second surface opposite the first surface, a first end, a second end opposite the first end, a first longitudinal edge, and a second longitudinal edge opposite the first edge, and an elongate pad comprising a support layer and opposite first and second surfaces, wherein the second surface of the pad is supported on the first surface of the base portion, and wherein the pad has sufficient support material between the first and second surfaces to afford supporting the wrists of the user on the first surface with a portion of the support layer beneath the wrists of the user;

at least one height adjustment member comprising a first surface, a first leg portion having a first support surface, and a second leg portion spaced from the first leg portion and having a second support surface, wherein the first surface of the height adjustment member is mounted on the second surface of the base portion so that the first and second support surfaces of the first and second leg portions project away from the base portion, and wherein the wrist rest pad assembly is supported by the at least one height adjustment member at a first distance above the support surface when located thereon; and at least one height adjustment pad having a thickness and a first position being removably attached to at least one of the first support surface and the second support surface of the at least one height adjustment member, wherein the wrist rest pad assembly is supported by the first and second leg portions of the height adjustment member and at least one height adjustment pad at a second distance above the support surface when located thereon, and a second position being removed from the at least one of the first and second support surfaces of the at least one height adjustment member, wherein the second distance is greater than the first distance.

23. An adjustable wrist rest assembly positionable on a support surface along the front edge of a device to be operated by a user's hands or fingers for supporting the wrists of the user who is positioned adjacent to the front edge of the support surface, the wrist rest assembly comprising:

a wrist rest pad assembly comprising a base portion having an first surface, a second surface opposite the first surface, a first end, a second end opposite the first end, a first longitudinal edge, and a second longitudinal edge opposite the first edge, and an elongate pad comprising a support layer and opposite first and second surfaces, wherein the second surface of the pad is supported on the first surface of the base portion, and wherein the pad has sufficient support material between the first and second surfaces to afford supporting the wrists of the user on the first surface with a portion of the support layer beneath the wrists of the user;

at least one height adjustment member having a first surface and at least one support surface generally opposite the first surface, wherein the first surface of the height adjustment member is mounted on the second surface of the base portion so that the at least one support surface of the height adjustment member projects away from the base portion, and wherein the wrist rest pad assembly is supported by the at least one height adjustment member at a first distance above the support surface when located thereon; and at least one height adjustment pad having a thickness and a first position being removably attached to the at least one support surface of the at least one height adjustment member, wherein the wrist rest pad assembly is supported by the height adjustment member and pad at a second distance above the support surface when located thereon, and a second position being removed from the at least one support surface of the at least one height adjustment member, wherein the second distance is greater than the first distance, and wherein the at least one height adjustment pad is removably adhered to the second surface of the base portion for convenient storage when removed from the at least one support surface of the at least one height adjustment member.

24. An adjustable wrist rest assembly positionable on a support surface along the front edge of a device to be operated by a user's hands or fingers for supporting the wrists of the user who is positioned adjacent to the front edge of the support surface, the wrist rest assembly comprising:

a wrist rest pad assembly comprising a base portion having an first surface, a second surface opposite the first surface, a first end, a second end opposite the first end, a first longitudinal edge, and a second longitudinal edge opposite the first edge, and an elongate pad comprising a support layer and opposite first and second surfaces, wherein the second surface of the pad is supported on the first surface of the base portion, and wherein the pad has sufficient support material between the first and second surfaces to afford supporting the wrists of the user on the first surface with a portion of the support layer beneath the wrists of the user;

at least one height adjustment member having a first surface and at least one support surface generally opposite the first surface, wherein the first surface of the height adjustment member is mounted on the second surface of the base portion so that the at least one support surface of the height adjustment member projects away from the base portion, and wherein the wrist rest pad assembly is supported by the at least one height adjustment member at a first distance above the support surface when located thereon; and at least one height adjustment pad having a thickness and a first position being removably attached to the at least one support surface of the at least one height adjustment member, wherein the wrist rest pad assembly is supported by the height adjustment member and pad at a second distance above the support surface when located thereon, and a second position being removed from the at least one support surface of the at least one height adjustment member, wherein the second distance is greater than the first distance, and wherein each of the at least one height adjustment pads has a top surface that is inclined relative to an opposite bottom surface.

25. An adjustable wrist rest assembly positionable on a support surface along the front edge of a device to be operated by a user's hands or fingers for supporting the wrists of the user who is positioned adjacent to the front edge of the support surface, the wrist rest assembly comprising:

an elongate pad comprising a support layer and opposite first and second surfaces, wherein the pad has sufficient support material between the first and second surfaces to afford supporting the wrists of the user on the first surface with a portion of the support layer beneath the wrists of the user;

at least one height adjustment member having a first surface and at least one support surface generally opposite the first surface, wherein the first surface of the height adjustment member is mounted on the second surface of the pad so that the at least one support surface of the height adjustment member projects away from the second surface of the pad, and wherein the elongate pad is supported by the at least one height adjustment member at a first distance above the support surface when located thereon; and at least one height adjustment pad having a thickness and a first position being removably attached to the at least one support surface of the at least one height adjustment member, wherein the elongate pad is supported by the height adjustment member and pad at a second distance above the support surface when supported thereon, and a second position being removed from the at least one support surface of the at least one height adjustment member, wherein the second distance is greater than the first distance, and wherein the at least one height adjustment pad is removably adhered to the second surface of the elongate pad for convenient storage when removed from the at least one support surface of the at least one height adjustment member.

* * * * *